United States Patent [19]

Dahowski

[11] Patent Number: 4,548,009

[45] Date of Patent: Oct. 22, 1985

[54] CONCRETE EXPANSION JOINT

[75] Inventor: Donald E. Dahowski, York, Pa.

[73] Assignee: Quaker Plastic Corporation, Mountville, Pa.

[21] Appl. No.: 589,366

[22] Filed: Mar. 14, 1984

Related U.S. Application Data

[63] Continuation-in-part of Ser. No. 294,107, Aug. 19, 1981, abandoned.

[51] Int. Cl.[4] ..... E04B 1/68; E01C 11/02

[52] U.S. Cl. ..... 52/396; 52/403; 404/48; 404/68

[58] Field of Search ..... 52/391, 393, 396, 403; 404/47–49, 64–67

[56] References Cited

U.S. PATENT DOCUMENTS

| | | | |
|---|---|---|---|
| 2,060,274 | 11/1936 | Awbrey | 404/67 |
| 3,180,238 | 4/1965 | Crone . | |
| 3,218,941 | 11/1965 | Daum | 404/65 |
| 3,352,217 | 11/1967 | Peters et al. . | |
| 3,604,169 | 9/1971 | Smith . | |
| 3,732,788 | 5/1973 | Brown . | |
| 3,775,918 | 12/1973 | Johnson . | |
| 3,871,787 | 3/1975 | Stegmeier . | |
| 3,896,597 | 7/1975 | Deason . | |
| 3,967,911 | 7/1976 | Miers . | |
| 4,008,974 | 2/1977 | Miers . | |

FOREIGN PATENT DOCUMENTS

| | | | |
|---|---|---|---|
| 73664 | 9/1944 | Czechoslovakia | 52/396 |
| 2249879 | 4/1974 | Fed. Rep. of Germany | 52/396 |
| 2307091 | 11/1976 | France . | |
| 2407422 | 6/1979 | France | 404/64 |

*Primary Examiner*—Donald G. Kelly
*Assistant Examiner*—Richard E. Chilcot, Jr.

[57] ABSTRACT

A concrete expansion and contraction joint is provided comprising a hollow single piece longitudinal extruded member having a cross sectional configuration which resembles an arrow head with a relatively narrow upper stem portion.

When the expansion joint is inserted into the fluid concrete aggregate, the V-shaped bottom of the arrow head structure moves aside any stones encountered in the concrete by the top of the arrow thereby facilitating installation. The top edges of the sides of the V-shape upon immersion in the concrete form locking anchors. Horizontal portions extending laterally on each side from the upper central stem portion of the joint to a point near the top of the V sides form flanges that provide channels which block downward water seepage at the joint.

5 Claims, 4 Drawing Figures

FIG. 1
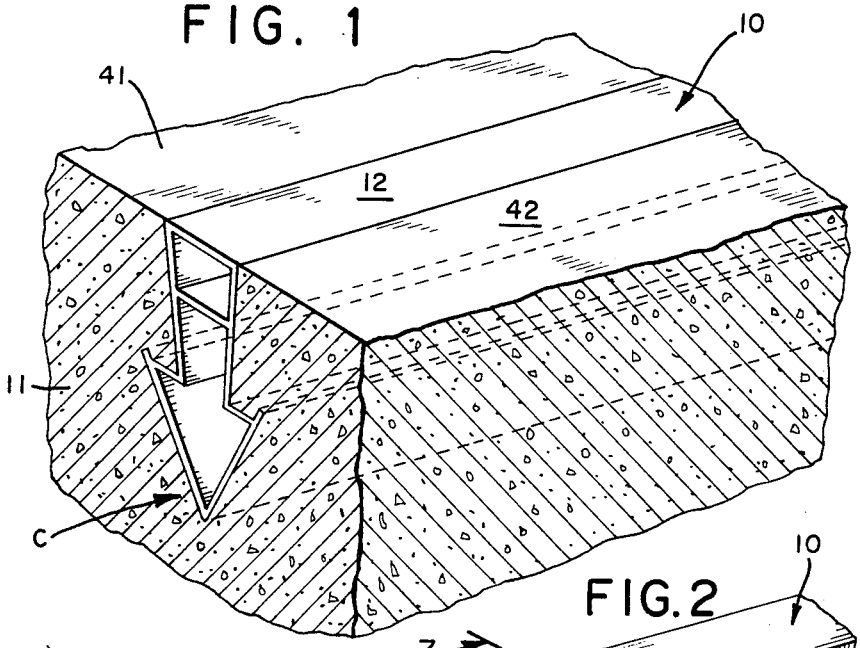
FIG. 2
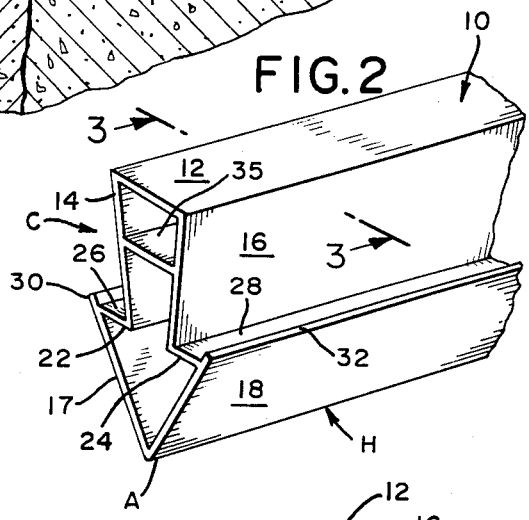
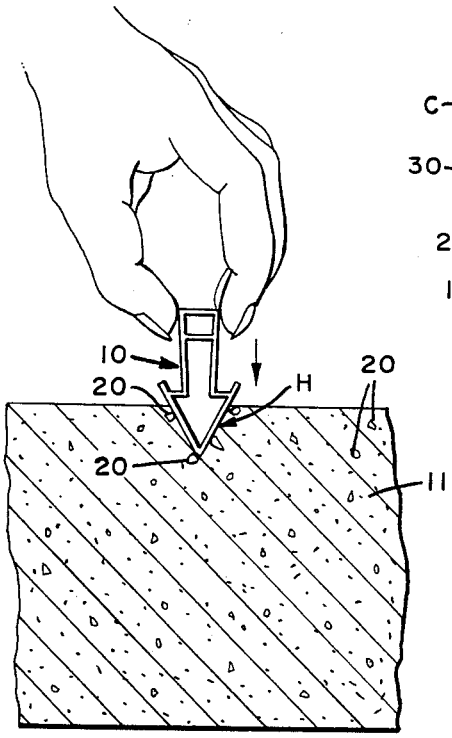
FIG. 4
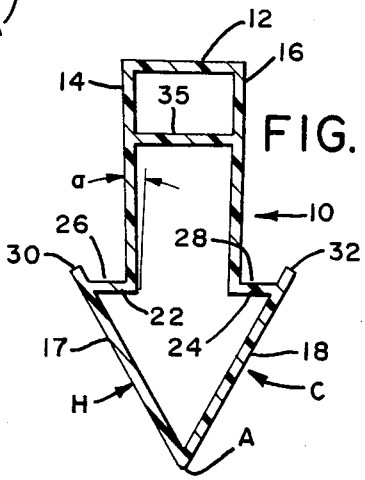
FIG. 3

CONCRETE EXPANSION JOINT

BACKGROUND OF THE INVENTION

This application is a continuation-in-part of application Ser. No. 294,107 filed on Aug. 19, 1981, now abandoned.

FIELD OF THE INVENTION

The present invention relates to a concrete expansion joint which functions to "absorb" the contraction and expansion of concrete slabs and thereby avoids or controls undesirable cracking and/or other consequential damage resulting from contraction/expansion forces. More particularly, the invention relates to a novel single piece expansion joint having an arrow head or V-shaped bottom configuration and increased functional strength which aids in forcing the expansion joint into place and facilitates the separation of the aggregate (stones) which may be in the path of the joint as it is inserted in the fluid cement.

DESCRIPTION OF THE PRIOR ART

The expansion and contraction consequences of the concrete are well known. Apart from the fact that cracks which develop are very unsightly, the results which follow the cracks present safety hazards and by allowing substantial amounts of water seepage, result in considerable property damage. In the vicinity of swimming pools, for example, it is most important that cracks and water seepage to the soil beneath be prevented because of the relatively severe and unsightly effect of having broken and uneven concrete slabs in the pool deck and because of the damage that seepage can cause to the pool body itself such as by the freezing of seepage water.

For these reasons, it is customary to use joint structures with concrete and similar materials at fixed intervals in the concrete surface to separate it into sections which may move relative to each other along the common boundaries defined by the joint.

In applying the joint strip element to the concrete, it is usually pressed into the fluid concrete after it has been poured and spread but before it has cured. The joint element does not extend completely through the concrete mass because it is substantially shorter in depth, i.e. in vertical cross section, than the concrete mass into which it is embedded. The concrete mass is then tamped; surfaced with a large or "bull" float; troweled, grooved, and edged; and then provided with a surface finish (a broomed or roughened surface) all after the joint element or structure is in place. Although a joint element of the type of the present invention does not penetrate to the bottom of the concrete mass in which it is embedded, the presence therein of the structural joint element introduces a line of weakness along which the concrete mass may crack or fissure. However, the crack, should it form, is covered by the joint structure or the joint strip conceals the crack and accommodates relative displacements of the sections contiguous to the crack.

Joint structures now in common use have a number of disadvantages among which include the difficulty encountered in pressing the joint into the concrete and in maintaining a straight line while embedding it in a concrete mass. There is a pronounced tendency of prior art expansion joints to distort because of the considerable force often applied to the joint when it is being pressed into the preset concrete. Another disadvantage occurs in that the exposed topwalls of such prior art structures are relatively weak and are often damaged (usually perforated) when a sharp object such as a pebble, narrow shoe heel, or child's toy is brought against the topwall. The reason that such joint structures are damaged along their topwalls is due to the fact that for practical reasons, a joint wall is made relatively thin. The reason for this is so that the entire quantity of material used in the joint structure will not make the cost of the joint such that it would not be practical to use the same in a cost-conscious market. Another disadvantage with certain decorative joint structures is that they do not provide a positive water stop which inhibits the downward flow of water from the top surface of the concrete mass to the underlying earthen bed via a path along the joint structure and to any crack underlying the same. Damage to a joint structure may increase the water-leakage tendency which is undesirable because moisture penetrating the underlying soil may cause the same to swell and heave. It is thus apparent that a need exists for an improved, effective, easy-to-install and economical concrete expansion-contraction joint.

SUMMARY OF THE INVENTION

The present invention provides an improved joint structure adapted to be embedded in concrete to accommodate the effects of contraction and expansion of concrete slabs and cracks which may form. The configuration of the joint element of the invention is relatively substantially rugged and overcomes the various disadvantages and limitations of conventional joint structures of the prior art.

The joint of the present invention is in the form of an "arrow head", i.e. a smooth V-shaped bottom, without interruption in the sides of the V, and has water blocking horizontal segments interiorly of the tops of the V-sides. The top of the V-sides extending slightly above the horizontal segments, provide an anchor for the joint. The elongated one piece extruded unit, comprising the expansion joint of the invention, provides a superior element that is relatively stiff or rigid especially in a transverse sense so that it can be readily pressed into pre-set concrete with considerable force without appreciably distorting the expansion joint. Also, because of structural rigidity of the expansion joint, it is more easily applied in a substantially straight line without difficulty by a person installing same.

In summary, the one-piece joint of the invention, which is extruded in longitudinal sections of convenient length, comprises a hollow arrow head configuration in cross section and has an upper relatively narrow stem portion and a lower V-shaped portion forming an apex at the bottom. The upper stem part of the expansion joint configuration resembles a stub of the shaft of an arrow and the lower portion, having two sides in the shape of a V with the apex at the bottom, represents the head of the arrow. At least one interior strengthening transverse web is preferably formed within the hollow cross section, connecting the sides of the joint. Such web is suitably positioned in the upper stem part of the expansion joint and positioned at a point intermediate the top and bottom of the upper stem portion. Horizontal segments extending from the bottom of the upper stem part to near the top of the V-sides comprise a structure which enhances the retention of the embedded joint element in position. The top end of the V-sides of the bottom portion of the expansion joint preferably extend slightly above the juncture of the horizontal segment which connects the central shaft with the V-side to provide a gutter-like water blocking trough to minimize seepage of water past and below the stem portion of the joint in the set concrete.

BRIEF DESCRIPTION OF THE DRAWING

The invention is illustrated in the accompanying drawing in which

FIG. 1 is a fragmentary perspective view showing the expansion joint of the present invention embedded within a concrete body.

FIG. 2 is a perspective view of a segment of the expanded joint.

FIG. 3 is a sectional view taken substantially along line 3—3 of FIG. 2

FIG. 4 is a sectional elevation view showing the expansion joint being manually immersed in a body of fluid, i.e. pre-set concrete.

DETAILED DESCRIPTION OF THE INVENTION

The concrete expansion joint of the invention is described in greater detail in the description which follows with reference being made to the figures of the drawing.

Referring to FIG. 1, an elongated concrete expansion joint, hereinafter sometimes referred to simply as the "joint", generally indicated 10 is shown embedded within a concrete mass 11. The expansion joint 10 is constructed with a particular cross-sectional configuration C, as detailed below, which can be readily extruded into desirable lengths such as eight feet, ten feet or twelve feet for use in embedding into uncured fluid concrete.

The joint may comprise an extrudate of, i.e. may be extruded from, any of a variety of suitable compositions including metals, such as aluminum, as well as synthetic resins. Suitable resins include various thermoplastic (as well as thermosetting compositions) such as polyvinyl chloride, various polyolefins e.g. polyethylene or propylene, polycarbonates, nylon, polyesters, polymethylmethacrylate, and the like, which are known by those skilled in the art as resins which possess suitable properties, e.g. rigidity, for an application of this kind.

The configuration of C of the expansion joint 10 comprises an upper stem portion having a top wall 72 with depending side walls 14 and 16, and having a lower V-shaped portion with sloping walls 17 and 18 extending angularly upwardly from an apex point A at the bottom. The lower portion, as shown in FIGS. 2 and 3, is in the form of a V-shaped arrow head designated H. The lower V-shaped portion facilitates the penetration and immersion of the joint into the uncured cement and when forced downward moves aside any aggregate 20 encountered in the fluid concrete 11 by the joint when it is being installed as illustrated in FIG. 4. A pair of lateral, substantially horizontal segments or webs 22 and 24 extend outwardly from each of the sides at the bottom of the upper portion, i.e. join the lower ends of the side walls 14 and 16 of the upper stem portion with the V-shaped walls 17 and 18, respectively, thereby forming channels or troughs 26 and 28 on either side of the walls 14 and 16 to minimize water seepage below these troughs. The horizontal dimension between the walls 14 and 16 of the upper stem portion may be, and preferably is, slightly smaller at the bottom than at the top.

The V-shaped walls 17 and 18 of the lower portion from the peak or apex A at the bottom to the ends of the tops of the sides 17 and 18, which comprise the outer extremities of the joint member, present smooth, uninterrupted lines with no interruption when the joint is being immersed into the concrete. This configuration substantially facilitates installation relative to such prior art joint structures which present side extensions or irregular contours that interfere with immersion of the joint in the preset concrete when pebbles, lumps, etc., in the concrete aggregate are encountered.

For proper strength one or more interior horizontal reinforcing connecting webs or elements may be incorporated internally intermediate the height of the expansion joint i.e. in either the upper or lower V portions. Preferably such web is positioned in the upper portion. As shown, a resilient web 35 extends between the side walls, 14 and 16 in the upper part and is located intermediately between the top wall 12 and the bottom of the upper portion, i.e. above the webs 22 and 24, to lend strength against possible buckling of the joint particularly at the time force is being applied to embed the joint in the concrete.

It can readily be appreciated that after the expansion joint 10 has been inserted into the uncured pre-set concrete, it forms a resilient means for absorbing the expansion and contraction of the cured concrete 11, FIG. 1. Furthermore, the top wall 12 of the joint 10 provides an unobtrusive and smooth surface connection between the sections 41 and 42 of the cured concrete 11. Optionally, the top 12 may be provided with decorative surface and/or may be covered with a strippable protective tape which is removed after the joint is embedded in the concrete.

The invention has been illustrated and described in considerable detail so that the configuration and advantages of the improved joint may be readily appreciated by those skilled in the art. It will be understood, however, that various changes may be made in such details without departing from the spirit or scope of the invention as set forth in the appended claims.

What is claimed is:

1. A structural joint element adapted to be embedded in concrete to accommodate expansion and contraction of concrete sections that are immediately contiguous to said joint element consisting essentially of longitudinal integrally formed hollow one-piece extruded member which in cross section is generally in the form of an arrow head, said one-piece member being formed of:

(a) a substantially rectangular shaped relatively narrow hollow upper stem portion having a pair of spaced substantially vertical side walls and a horizontal wall closing the top of said side walls;

(b) a V-shaped lower portion, the sides of said V-shaped lower portion forming an apex at the bottom and the top of said sides of said V-shaped portion being spaced from and being connected to said upper stem portion by (c) substantially horizontal segments extending outwardly from the bottom of each of said side walls of the upper stem portion and connected contiguous to the top, and at the inner face, of the sides of said V-shaped lower portion, and (d) a transverse web spanning the interior of the upper stem portion and joining said spaced substantially vertical side walls at a point intermediate the top and bottom of said vertical side walls of the upper stem portion.

2. The joint structure of claim 1 wherein the segments extending horizontally or located slightly below the top of the V-shaped sides whereby the area defined by said horizontal segments, said vertical walls and said top part of the V sides above the horizontal segments form a trough.

3. The joint structure of claim 1 wherein the horizontal cross sectional dimension at the lower end of said upper portion is less than that of the horizontal dimension at the upper end of said upper portion.

4. The joint structure of claim 1 comprising an extrudate of a synthetic resinous composition.

5. The joint structure of claim 1 comprising an extrudate of metal.

* * * * *